US006908326B2

(12) United States Patent
Shiota et al.

(10) Patent No.: US 6,908,326 B2
(45) Date of Patent: Jun. 21, 2005

(54) FLOATING CONNECTOR

(75) Inventors: Koji Shiota, Daito (JP); Yuichi Tonai, Suita (JP); Mitsuhiro Matsumoto, Higashiosaka (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/912,035

(22) Filed: Aug. 4, 2004

(65) Prior Publication Data

US 2005/0032406 A1 Feb. 10, 2005

(30) Foreign Application Priority Data

Aug. 8, 2003 (JP) ..... 2003-290705

(51) Int. Cl.[7] ..... H01R 13/64
(52) U.S. Cl. ..... 439/247
(58) Field of Search ..... 439/660, 65, 245–249, 439/852, 552–557

(56) References Cited

U.S. PATENT DOCUMENTS

| | | | | | |
|---|---|---|---|---|---|
| 5,199,900 | A | * | 4/1993 | Hayes, Sr. | 439/557 |
| 6,609,922 | B2 | * | 8/2003 | Torii | 439/247 |
| 6,733,305 | B2 | * | 5/2004 | Pan et al. | 439/74 |
| 6,837,727 | B2 | * | 1/2005 | Migimatsu et al. | 439/247 |
| 2002/0013079 | A1 | * | 1/2002 | Yoshimatsu et al. | 439/247 |

FOREIGN PATENT DOCUMENTS

| | | |
|---|---|---|
| EP | 0371835 | 6/1990 |
| JP | 5015369 | 2/1993 |
| JP | 6048190 | 6/1994 |
| JP | 6325825 | 11/1994 |
| JP | 7022865 | 5/1995 |
| JP | 8306448 | 11/1996 |
| JP | 9180829 | 7/1997 |
| JP | 11045767 | 2/1999 |
| JP | 11111408 | 4/1999 |
| JP | 11273807 | 10/1999 |
| JP | 11288759 | 10/1999 |
| JP | 3122926 | 10/2000 |
| JP | 2002-352908 | 12/2002 |

* cited by examiner

*Primary Examiner*—J. F. Duverne
(74) *Attorney, Agent, or Firm*—W. F. Fasse; W. G. Fasse

(57) ABSTRACT

To provide a floating connector wherein strengths against pull-out forces in the height direction are high and both housings are resistant to separation, the slide housing slides in any direction perpendicular to the height direction to reliably absorb the deviation in the position of the floating connector in relation to that of the counterpart connector without resulting in any defective contact with the counterpart contacts nor buckling of the contacts, the floating connector can be produced easily, and the floating connector has a high self-supportability through setting an appropriate rigidity of the contacts. It is a floating connector wherein the connecting parts of the contacts are pressed into the base housing, the contacting parts of the contacts are pressed into the slide housing, and both housings are so related to each other by means of protruding parts protruding in the width direction and grooves into which the protruding parts are inserted that both housings can slide in any directions perpendicular to the height direction.

8 Claims, 6 Drawing Sheets

FLOATING CONNECTOR

BACKGROUND OF THE INVENTION

1. Field of the Invention

The present invention belongs to the field of electric connectors and relates to a floating connector that can engage with a counterpart connector, even if there is a deviation in its position in relation to the counterpart connector, by absorbing that deviation.

2. Related Art

Japanese Utility Model Examined Publication Heisei 7-22865 discloses a multi-pole connector wherein a plurality of contact fixing holes are provided inside an insulator housing for receiving and holding contacts, each of which has a contacting part at the top end and a solder tail at the bottom, and inside each of the contact fixing holes a single fixing means for a contact is provided, into which a base part of the contacting part of the corresponding contact is forced and fixed. In the case of this multi-pole connector, in order to absorb and adjust relative positional deviations in two directions perpendicular to each other between the above-mentioned contacting part and the above-mentioned solder tail, the above-mentioned contact is integrally provided with a U-shaped upper spring formed by bending to provide flexibility in the first direction of pressing the above-mentioned base body into, a worked part bent from the U-shaped upper spring, a U-shaped lower spring formed by punching to provide a U-shaped form in the same orientation as the above-mentioned U-shaped upper spring, and a drop-off preventing means provided between the U-shaped lower spring and the above-mentioned solder tail; the above-mentioned drop-off preventing means has a tongue that fits on the above-mentioned insulator housing to prevent the above-mentioned contact from dropping off from the above-mentioned insulator housing due to a shift in the above-mentioned first direction between the above-mentioned insulator housing and the above-mentioned solder tail.

Japanese Patent Unexamined Publication Heisei 11-111408 discloses a connector device comprising a connector holding a plurality of conductive contacts and a counterpart connector holding a plurality of conductive counterpart contacts that are to contact the above-mentioned contacts, wherein the above-mentioned connector and the above-mentioned counterpart connector are relatively moved in an engaging direction to make the above-mentioned contacts and the above-mentioned counterpart contacts contact each other. In the case of this connector device, the above-mentioned connector comprises a base insulator holding the above-mentioned contacts and a guide insulator to be combined with the base insulator, and the above-mentioned base insulator comprises a base plate part, a pair of elastically-deformable first fitting-on pieces that are provided to extend in opposing planes of the base plate part and face each other in the opposing planes at a given interval, first hook parts formed on the top ends of the pair of first fitting-on pieces, and first receiving parts formed in the above-mentioned base plate part to receive the above-mentioned contacts, and the above-mentioned guide insulator comprises a groove part formed to receive the above-mentioned counterpart connector and second receiving parts for receiving the above-mentioned contacts, and the above-mentioned contacts comprise a contacting part located at the above-mentioned groove part, an intermediate part being continuous with one end of the contacting part and to be received in the above-mentioned first receiving part, an elastically-deformable floating part being located in a part of the intermediate part and to be located in the above-mentioned first receiving part so that it can undergo elastic deformation, a holding part being continuous with one end of the floating part and to be held in the above-mentioned first receiving part, and a connecting part being continuous with one end of the holding part and extending out of the above-mentioned base plate part, and the above-mentioned guide insulator is provided with positioning holes for receiving the above-mentioned first fitting-on pieces and first fitting-on stepped parts formed on walls of the positioning holes to fit on the first hook parts of the above-mentioned fitting-on pieces.

SUMMARY OF THE INVENTION

As the contact of the multi-pole connector of Japanese Utility Model Examined Publication Heisei 7-22865 has the U-shaped upper spring and the U-shaped lower spring of the same orientation, its dimension in the first direction will be large, posing a problem of larger connector size. Moreover, the tongue of the drop-off preventing means is not free from slackness even when it fits on the insulator housing because of its structure, hence there exists a relative shift of the contact in relation to the insulator housing, and the amount of protrusion of the contact from the insulator housing varies.

In contrast to it, the contacts of the connector device of Japanese Patent Unexamined Publication Heisei 11-111408 are formed substantially straight in the direction of engaging with the counterpart connector, hence the growth in size of the connector in the direction perpendicular to this engaging direction is prevented. Moreover, as the holding part of the contact is pressed into the first receiving part of the base insulator, the amount of protrusion of the contact out of the base insulator or the guide insulator is fixed.

The connector device of Japanese Patent Unexamined Publication Heisei 11-111408 has a structure wherein the pair of first fitting-on pieces extending from the base insulator are fitted on the positioning stepped parts of the guide insulator and the guide insulator is enabled to move in relation to the base insulator along a plane perpendicular to the direction of engaging with the counterpart connector. Accordingly, there is a possibility that when a strong pull-out force works on the base insulator and the guide insulator in the direction of engaging with the counterpart connector, the fitting-on forces between the first fitting-on pieces and the positioning stepped parts will reach the limit and the base insulator and the guide insulator will be separated from each other.

In the production of this connector device it is necessary to execute a task to fitting the pair of the first fitting-on pieces of the base insulator on the positioning stepped parts of the guide insulator and a task to press the holding parts of the contacts into the first receiving parts of the base insulator and putting the intermediate parts of the contacts in the second receiving parts of the guide insulator, hence the tasks are complicated. Moreover, if the dispersion of the fitting-on positions of the first fitting-on pieces and the positioning stepped parts is not small, the first receiving parts and the second receiving parts will not align to each other. This will require another task to flex the first fitting-on pieces and align them and insert the contacts into the receiving parts, thus the workability will be deteriorated.

Moreover, as the floating parts of the contacts are of a plate form, the floating parts will flex easily when they are made to flex in their thickness direction, and the floating parts will tend to absorb the deviation in the position of the connector in relation to that of the counterpart connector. However, when the floating parts are made to flex in their width direction, the resistance will be greater, and it will be hard to absorb the deviation. Furthermore, as the intermediate parts of the contacts are merely put in the receiving parts of the guide insulator, there is a possibility that when the floating parts are flexed, the contacting parts will shift in relation to the guide insulator. This, in turn, leads to a possibility that defective contacts will arise between the contacting parts of the contacts and the counterpart contacts or a possibility that the contacting parts of the contacts will contact the counterpart contacts and buckle themselves.

The present invention was made in view of these points, and its object is to provide a floating connector wherein a base housing and a slide housing are related to each other by means of protruding parts protruding in the width direction and grooves into which the protruding parts are inserted, both the base housing and the slide housing are elastically coupled together by means of contacts, which penetrate both the base housing and the slide housing and both ends thereof are pressed into the respective housings, so that strengths against pull-out forces in the height direction are high and both housings are resistant to separation, the slide housing slides in any direction perpendicular to the height direction to reliably absorb the deviation in the position of the floating connector in relation to that of the counterpart connector without resulting in any defective contact with the counterpart contacts nor buckling of the contacts, and moreover, the floating connector can be produced easily, and the floating connector has a high self-supportability through setting an appropriate rigidity of the contacts.

Moreover, the present invention also has an object of reliably fitting its locking part on the counterpart connector.

To accomplish the above-mentioned objects, the floating connector according to the present invention comprises, when a depth direction, a width direction and a height direction all being perpendicular to each other are assumed, an insulative base housing wherein a first contacting face facing the height direction is formed at one end thereof in the height direction and first through holes are provided to penetrate the base housing in the height direction, an insulative slide housing wherein a second contacting face facing the height direction is formed at one end thereof in the height direction to contact the first contacting face of the base housing and second through holes to be continuous with the first through holes of the base housing are provided to penetrate the slide housing in the height direction, and conductive contacts being to be inserted into the first through hole of the base housing and the second through hole of the slide housing from one side in the height direction and having a connecting part, which is to be pressed into the first through hole of the base housing and of which top end part is to protrude from the first through hole and be connected to a conductor of an external member, a contacting part, which is to be pressed into the second through hole of the slide housing and to contact a contact of a counterpart connector, and a floating part, which is provided between the connecting part and the contacting part and is able to undergo elastic deformation so that the contacting part and the connecting part can shift in any directions perpendicular to the height direction, and the floating connector being so structured that either one of the base housing and the slide housing is provided with protruding parts protruding on both sides in the width direction thereof, the other one of the base housing and the slide housing is provided with grooves on both sides in the width direction thereof, the grooves being concaved outward in the width direction, extending in the depth direction and being open at least on this side in the depth direction, and the protruding parts are inserted into the grooves, leaving spaces in both the width direction and the depth direction to enable the slide housing to slide in relation to the base housing in any direction perpendicular to the height direction while restraining the slide housing from shifting in the height direction.

In the case of this floating connector, the slide housing is enabled to slide in relation to the base housing in any direction perpendicular to the height direction and is restrained from shifting in the height direction by inserting the protruding parts into the grooves, leaving spaces in both the width direction and the depth direction. Moreover, if the slide housing slides in relation to the base housing, the floating parts of the contacts will undergo elastic deformation to absorb it. Accordingly, even when there is a deviation in the position of the floating connector in relation to the counterpart connector, this deviation will be absorbed by the sliding of the slide housing and the floating connector will be engaged with the counterpart connector. In that case, the strength against the pull-out force in the height direction will increase, reducing the possibility of separation of the base housing and the slide housing. Moreover, the slide housing is able to slide freely in any direction perpendicular to the height direction to reliably absorb the deviation in the position of the floating connector in relation to the counterpart connector. As the contacting part of the contact is pressed into the second through hole of the slide housing, even when the floating part is flexed, the contacting part will not shift in relation to the slide housing, the contacting part of the contact will not have defective contact between it and the counterpart contact, and the contacting part of the contact will not contact the counterpart connector to buckle itself. The floating connector can be produced easily by inserting one of the base housing and the slide housing into the other, inserting the contacts into the first through holes and the second through holes and pressing the contacts into the base housing and the slide housing. Moreover, the floating connector with high self-supportability can be produced by properly setting the rigidity of the contacts.

In the floating connector of the present invention the base housing and the slide housing are related to each other by means of protruding parts protruding in the width direction and grooves into which the protruding parts are inserted, and both the base housing and the slide housing are elastically coupled together by means of contacts, which penetrate both the base housing and the slide housing and both ends thereof are pressed into the respective housings, hence the present invention successfully provided a floating connector wherein strengths against pull-out forces in the height direction are high and both housings are resistant to separation, the slide housing slides in any direction perpendicular to the height direction to reliably absorb the deviation in the position of the floating connector in relation to that of the counterpart connector without resulting in any defective contact with the counterpart contacts nor buckling of the contacts, and moreover, the floating connector can be produced easily, and the floating connector has a high self-supportability through setting an appropriate rigidity of the contacts.

In the above-mentioned floating connector according to the present invention the floating part of the contact may be structured by providing a first plate face and a second plate face facing two directions, which are perpendicular to the height direction and cross mutually, in succession in the height direction.

With this arrangement, as an elastic flexure of the first plate face and an elastic flexure of the second plate face are synthesized to enable the contacting part and the connecting part to shift in any direction perpendicular to the height direction, thus the floating part is realized with a simple structure.

In the above-mentioned floating connectors of the present invention it may be arranged that a second protruding part for biting into a wall constituting the second through hole is formed on the contacting part of the contact, the first through hole is so provided that this contacting part and the second protruding part can pass through it, and a first protruding part for biting into a wall constituting the first through hole is formed on the connecting part of the contact.

With this arrangement, when the contact, with its contacting part ahead, is inserted into the first through hole, the contacting part will pass through the first through hole and enter the second through hole, the second protruding part will bite into the wall constituting the second through hole, and the first protruding part of the connecting part will bite into the wall constituting the first through hole; thus the pressing-in of the contact will be completed.

Accordingly, the contacts can be pressed into the first through holes of the base housing and the second through holes of the slide housing from the base housing side.

In the above-mentioned floating connectors of the present invention, the slide housing may be provided with a locking part that fits on the counterpart connector.

With this arrangement, even when there is a deviation in the relative position of the floating connector and the counterpart connector, this deviation will be absorbed by the sliding of the slide housing, and the locking part will be able to be fitted on the counterpart connector reliably.

PREFERRED EMBODIMENT OF THE INVENTION

Figure 1:
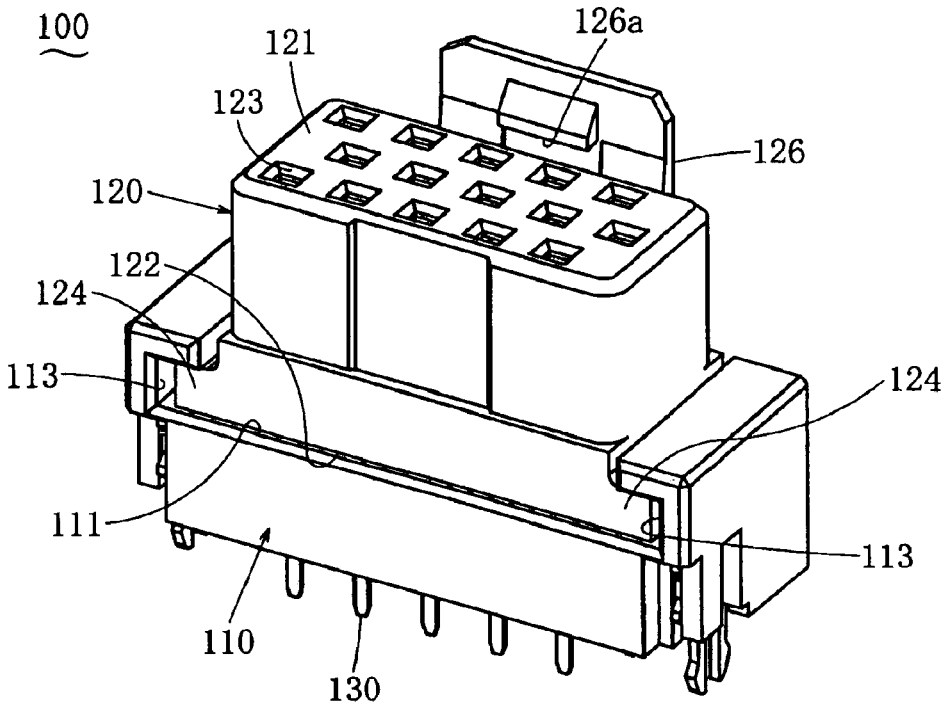
FIG. 1 is a perspective view showing the floating connector of an embodiment of the present invention.
Figure 2:
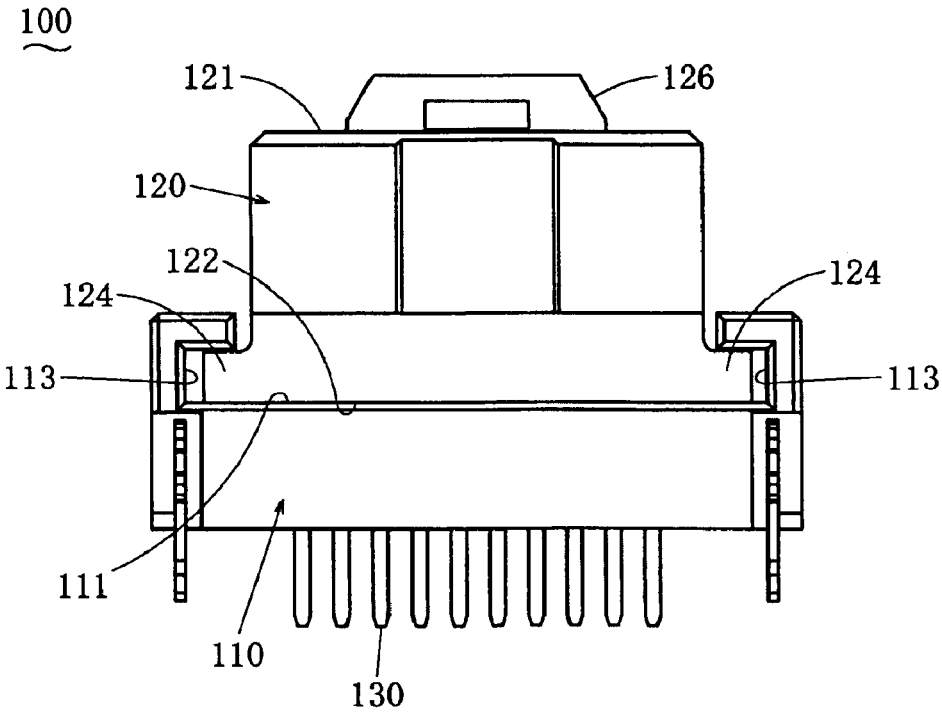
FIG. 2 is a front view of the floating connector of the embodiment seen from this side in the depth direction.
Figure 3:
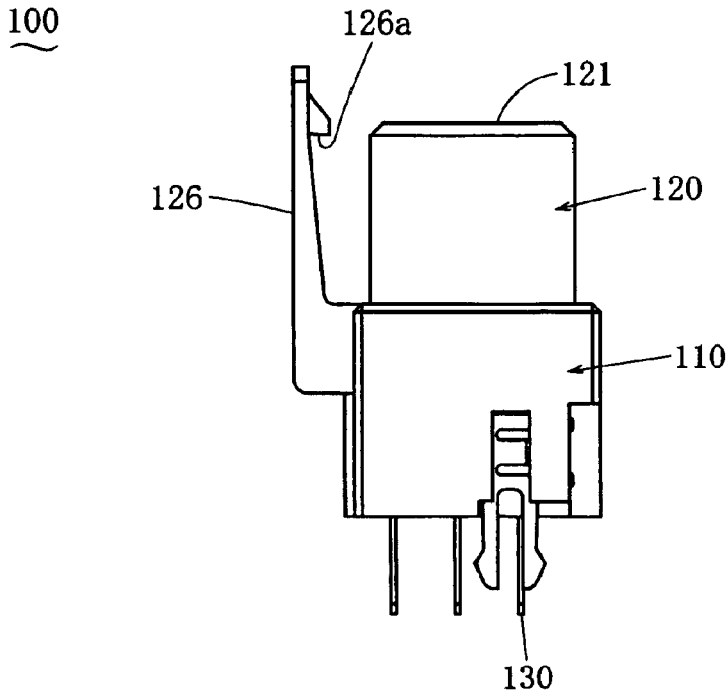
FIG. 3 is a left side view of the floating connector of the embodiment seen in the width direction.
Figure 4:
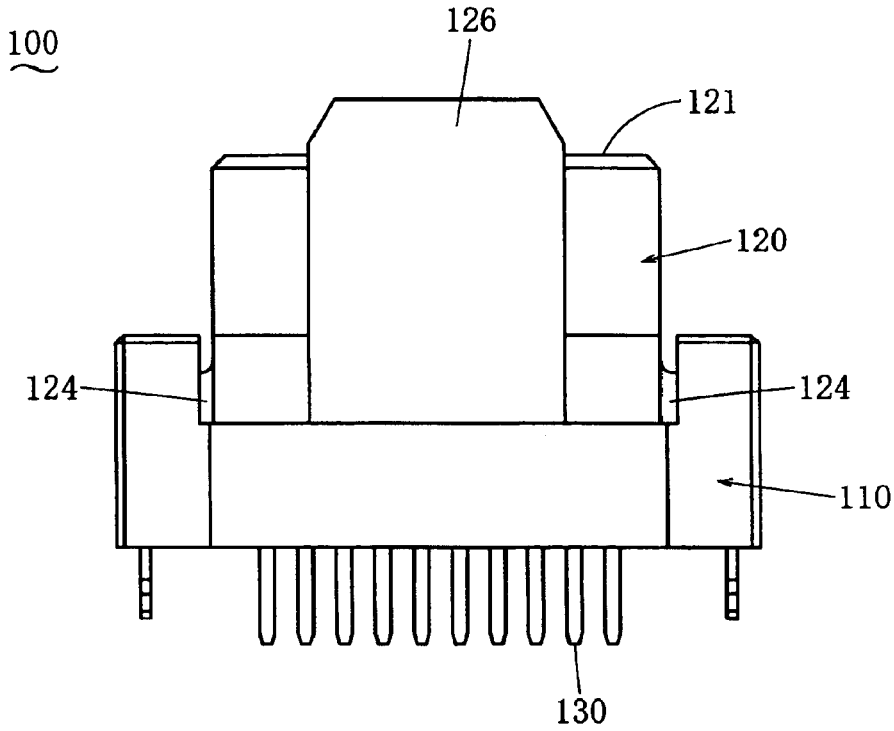
FIG. 4 is a rear view of the floating connector of the embodiment seen from the rear in the depth direction.
Figure 5:
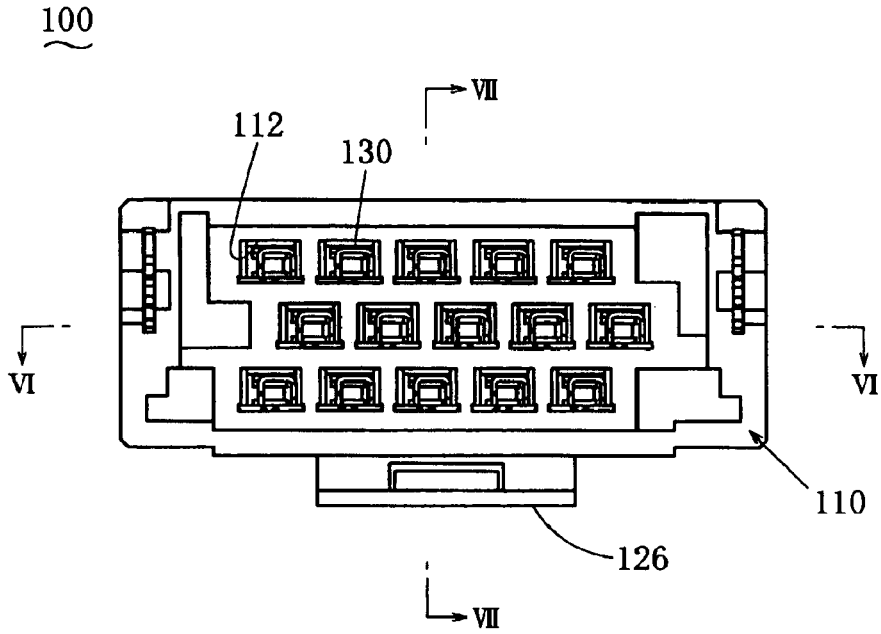
FIG. 5 is a bottom view of the floating connector of the embodiment seen in the height direction.
Figure 6:
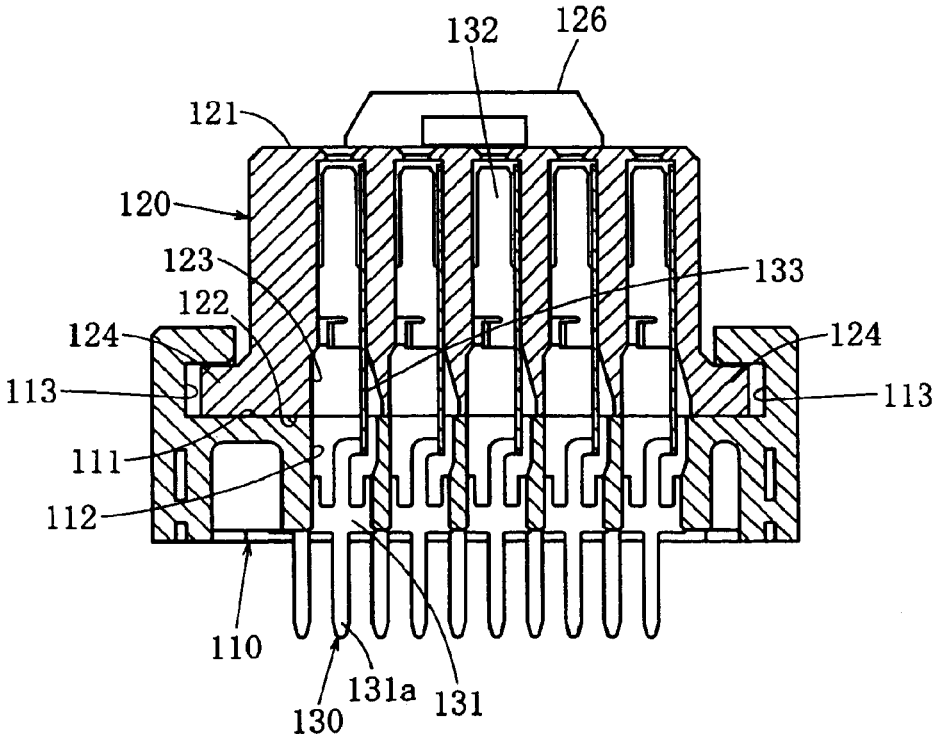
FIG. 6 is a sectional view along the line VI—VI of FIG. 5.
Figure 7:
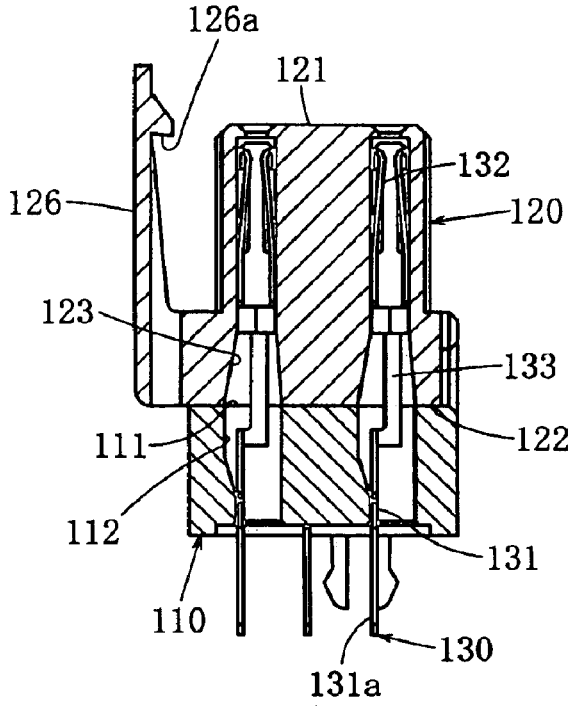
FIG. 7 is a sectional view along the line VII—VII of FIG. 5.
Figure 11:
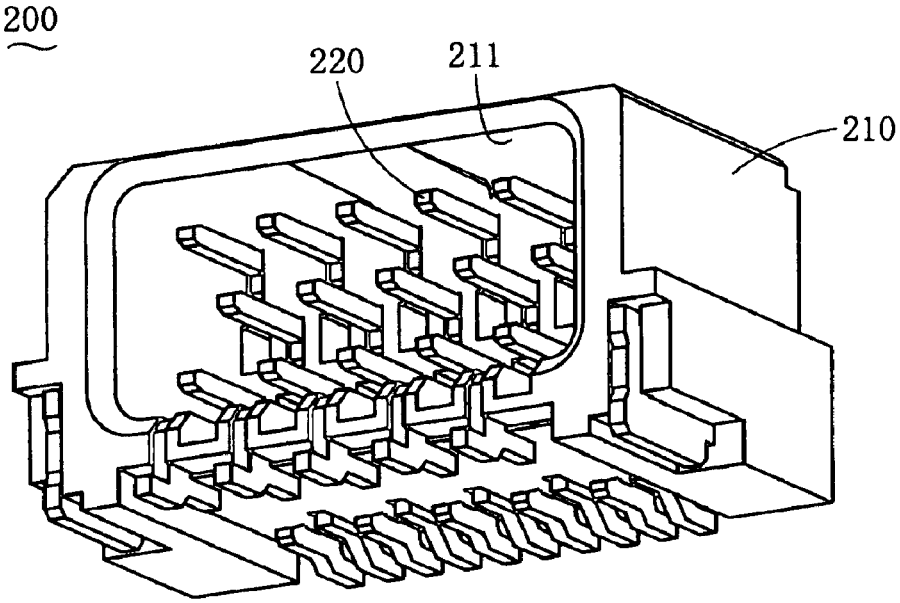
FIG. 11 is a perspective view of a counterpart connector.
Figure 12:
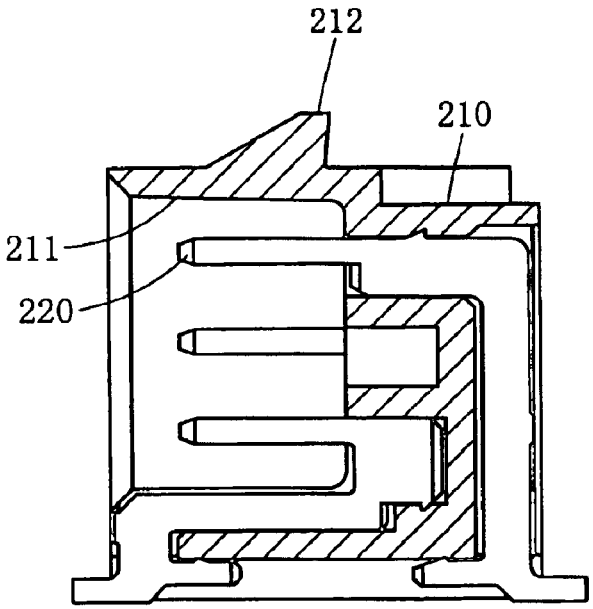
FIG. 12 is a longitudinal sectional view of the counterpart connector.

In the following, some embodiments of the present invention will be described. FIG. 1 through FIG. 7 show a floating connector 100 being an embodiment of the present invention. This floating connector 100 is engaged with or disconnected from a counterpart connector 200 shown in FIG. 11 and FIG. 12. Such engagement and disconnection are done in the height direction. The floating connector 100 of this embodiment is provided with a convex part 121, and the engagement is effected by inserting this convex part 121 into a concave part 211 of the counterpart connector 200. This relationship, however, may be reversed. The floating connector 100 of this embodiment is provided with female contacts 130, and the connection is effected when these contacts 130 are engaged with male contacts 220 of the counterpart connector 200. This relationship, however, may be reversed. A depth direction, a width direction and a height direction all being perpendicular to each other are assumed and the system of these directions are used in the following description. In the case of this embodiment, with reference to FIG. 3, the left-right direction of FIG. 3 is the depth direction, the left side of FIG. 3 is the rear in the depth direction, and the right side of FIG. 3 is this side in the depth direction. The direction perpendicular to the plane of the paper of FIG. 3 is the width direction, and the top-bottom direction of FIG. 3 is the height direction.

The floating connector 100 comprises an insulative base housing 110 and an insulative slide housing 120 that overlaps the base housing 110 in the height direction. A first contacting face 111 facing the height direction is formed on one end in the height direction of the base housing 110. The base housing 110 is provided with first through holes 112 penetrating through the base housing 110 in the height direction. A second contacting face 122 is formed on one end in the height direction of the slide housing 120, the second contacting face 122 facing the height direction and being to contact the first contacting face 111. The slide housing 120 is provided with second through holes 123 penetrating through the slide housing 120 in the height direction, the second through holes 123 are to be continuous to the first through holes 112.

The floating connector 100 is provided with conductive contacts 130 spanning between the base housing 110 and the slide housing 120. This contact 130 is inserted into the first through hole 112 of the base housing 110 and the second through hole 123 of the slide housing 120 from one side in the height direction. This contact 130 is provided with a connecting part 131, a contacting part 132 and a floating part 133 located between the connecting part 131 and the contacting part 132. The connecting part 131 is pressed into the first through hole 112 of the base housing 110. The top end part 131*a* of this connecting part 131, namely, the end of the connecting part 131 opposite to the floating part 133 protrudes outward from the first through hole 112, and this top end part 131*a* is connected to a conductor of an external member. This external member is, for example, a printed circuit board, and the connecting form is, for example, soldering. The contacting part 132 is pressed into the second through hole 123 of the slide housing 120 and contacts the contact 220 of the counterpart connector 200. In the case of this embodiment, the contact 130 is of the female type, hence the contacting part is almost formed into a box. The contacting part 132 may entirely rest in the second through hole 123 or may partly protrude outward from the second through hole 123. The floating part 133 undergoes elastic deformation so that the contacting part 132 and the connecting part 131 can shift in any directions perpendicular to the height direction.

The slide housing 120 is provided with protruding parts 124 protruding on both sides in the width direction. The base housing 110 is provided with grooves 113 on both sides in the width direction, the grooves 113 being concaved outward in the width direction, extending in the depth direction and being open at least on this side in the depth direction. The grooves 113 may be opened at the rear in the depth direction. They are so structured that when the protruding parts 124 are inserted into the grooves 113, leaving spaces in both the width direction and the depth direction, the slide housing 120 can slide in relation to the base housing 110 in any direction perpendicular to the height direction while the slide housing 120 is restrained from shifting in the height direction. Reversely to this embodiment, they may be arranged so that the base housing is provided with the protruding parts and the slide housing with grooves.

Figure 8:
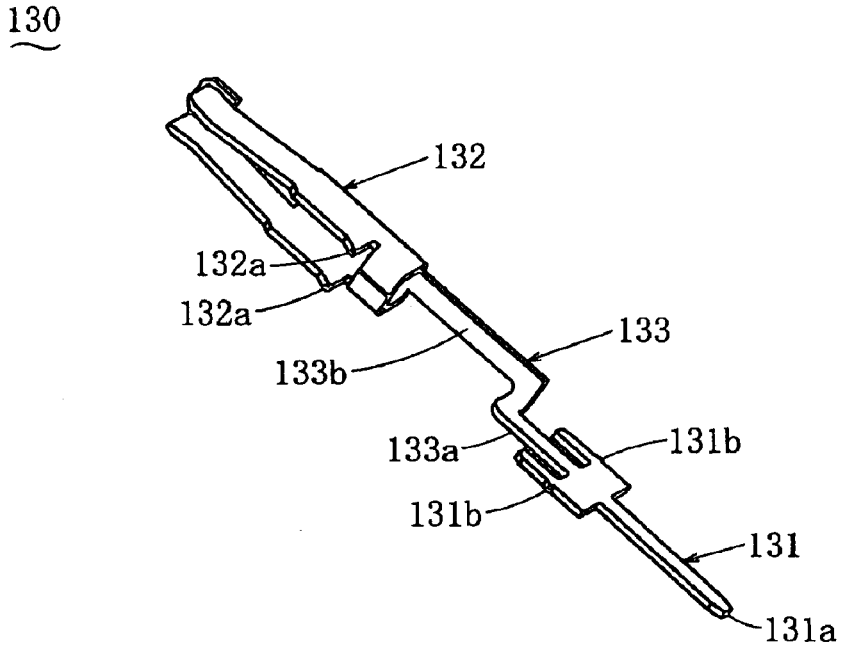
FIG. 8 is an enlarged perspective view of a contact.
Figure 9:
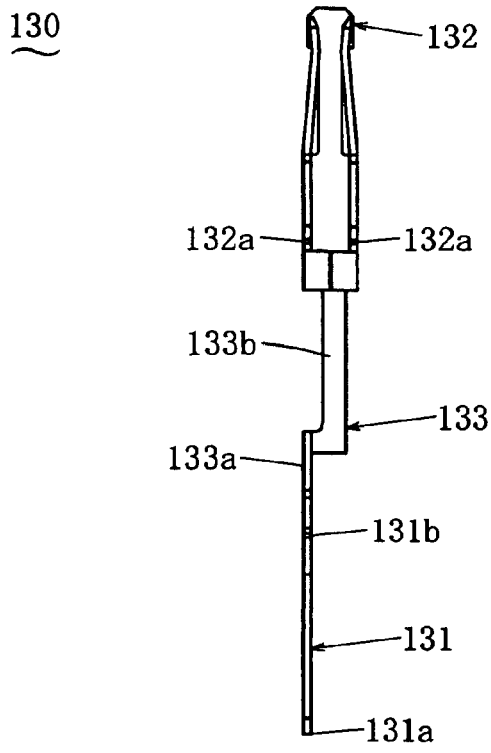
FIG. 9 is an enlarged side view of the contact seen in the width direction.
Figure 10:
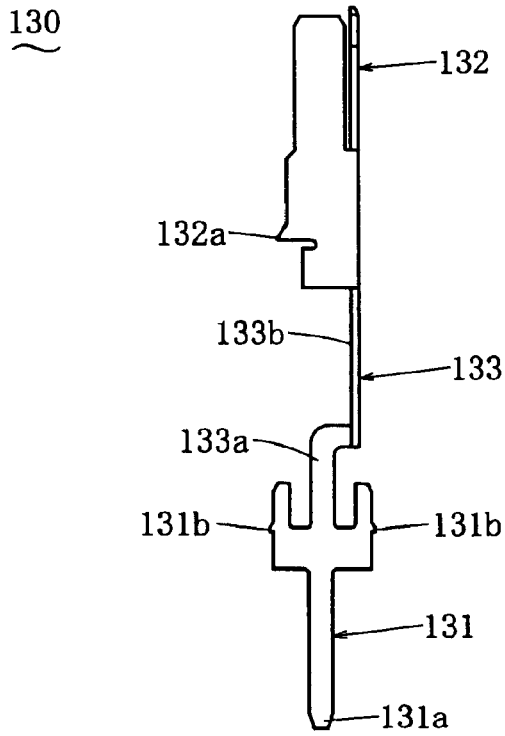
FIG. 10 is an enlarged front view of the contact seen from this side in the depth direction.

As shown in FIG. 8 through FIG. 10, the floating part 133 of the contact 130 is structured by providing a first plate face 133*a* and a second plate face 133*b* facing two directions, which are perpendicular to the height direction and cross mutually, in succession in the height direction. It is preferable from the viewpoint of balance of powers and from the viewpoint of ease in production that the two directions crossing mutually are two directions crossing perpendicularly. It, however, is sufficient that the two directions cross mutually, and it is not limited to the perpendicular crossing. This contact 130 is formed by bending a single blank.

Second protruding parts 132*a* that are to bite into walls constituting the second through hole 123 are formed on the contacting part 132 of the contact 130, and the first through hole 112 is so provided that this contacting part 132 and the second protruding parts 132*a* can pass through it. First protruding parts 131*b* that are to bite into walls constituting the first through hole 112 are formed on the connecting part 131 of the contact 130. The second protruding parts 132*a* protrude in such a way that they extend the profile of the contacting part 132 seen in the height direction, and the first protruding parts 131*b* protrude in such a way that they extend the profile of the connecting part 131 seen in the height direction.

The slide housing 120 is provided with a locking part 126 that fits on the counterpart connector 200. This locking part 126 is an arm extending in the height direction and is provided with a hook 126*a* at the top end thereof. This hook 126*a* fits on a locking part 212, which is provided on the housing 210 of the counterpart connector 200 to protrude from it, to prevent the base housing 110 and the slide housing 120 from easy separation.

Accordingly, in the case of this floating connector 100, it is made possible for the slide housing 120 to slide in relation to the base housing 110 in any direction perpendicular to the height direction while the slide housing 120 being restrained from shifting in the height direction by inserting the protruding parts 124 in the grooves 113, leaving spaces in the width direction and the depth direction. If the slide housing 120 slides in relation to the base housing 110, the floating parts 133 of the contacts 130 will absorb the sliding by undergoing elastic deformation. As a result, even if there is a deviation in the position in relation to that of the counterpart connector 200, this deviation will be absorbed by the sliding of the slide housing 120 and the floating connector 100 will be able to engage with the counterpart connector 200. In that case, as the strength against a pull-out force in the height direction is enhanced, the possibility of separation of the base housing 110 and the slide housing 120 will be reduced. Moreover, as the slide housing 120 can slide freely in any direction perpendicular to the height direction, it will reliably absorb the deviation in the position in relation to that of the counterpart connector. As the contacting part 132 of the contact 130 is pressed into the second through hole 123 of the slide housing 120, the contacting part 132 will not shift in relation to the slide housing 120 even if the floating part 133 is flexed, and the contacting part 132 of the contact 130 will not make defective contact against the counterpart contact 220, and the contacting part 132 of the contact 130 will not buckle due to contacting the counterpart connector 200. Moreover, the floating house 100 can be produced easily by inserting either one of the base housing 110 and the slide housing 120 into the other, inserting each contact 130 into the first through hole 112 and the second through hole 123 and pressing each contact 130 into the base housing 110 and the slide housing 120. Furthermore, when the setting of the rigidity of the contact 130 is done properly by, for example, selecting its plate thickness, the floating connector 100 having high self-supportability will be obtained.

It is sufficient for the floating part of the contact according to the present invention that the floating part is provided between the connecting part and the contacting part and the floating part can undergo elastic deformation so that the contacting part and the connecting part can shift in any directions perpendicular to the height direction. However, in the case of the above-mentioned embodiment, the floating part 133 of the contact 130 is structured by providing the first plate face 133*a* and the second plate face 133*b* facing two directions, which are perpendicular to the height direction and cross mutually, in succession in the height direction. With this arrangement, an elastic flexure of the first plate face 133*a* and an elastic flexure of the second plate face 133*b* are synthesized to enable the contacting part 132 and the connecting part 131 to shift in any directions perpendicular to the height direction, hence the floating part 133 is realized by a simple structure.

It is sufficient for the contact according to the present invention that the contact is so structured that the contact is inserted into the first through hole of the base housing and the second through hole of the slide housing from one side in the height direction, the connecting part is pressed into the first through hole of the base housing, and the contacting part is pressed into the second through hole of the slide housing. In the case of the above-mentioned embodiment, the second protruding parts 132*a* that bite into the walls constituting the second through hole 123 are formed on the contacting part 132 of the contact 130, the first through hole 112 is provided in such a way that the contacting part 132 and the second protruding parts 132*a* can pass through the first through hole 112, and the first protruding parts 131*b* that bite into the walls constituting the first through hole 112 are formed on the connecting part 131 of the contact. With this arrangement, when the contact 130 is inserted, with the contacting part 132 at the head, into the first through hole 112 of the base housing 110, the contacting part 132 will pass through the first through hole 112, enter the second through hole 123 of the slide housing 120, the second protruding parts 132*a* will bite into the walls constituting the second through hole 123, and the first protruding parts 131*b* of the connecting part 131 will bite into the walls constituting the first through hole 112; thus the pressing-in of the contact 130 will be completed.

The present invention includes embodiments of the floating connector wherein no locking part is provided. In the above-mentioned embodiment, however, the slide housing 120 is provided with the locking part 126 that fits on the counterpart connector 200. With this arrangement, even when there is a deviation in the relative positions of the floating connector 100 and the counterpart connector 200, this deviation will be absorbed by the sliding of the slide housing 120 and the locking part 126 will be able to fit on the counterpart connector 200 reliably.

The present invention includes embodiments wherein features of the above-mentioned embodiments are combined.

What is claimed is:

1. A floating connector comprising when a depth direction, a width direction and a height direction all being perpendicular to each other are assumed, an insulative base housing wherein a first contacting face facing the height direction is formed at one end thereof in the height direction and first through holes are provided to penetrate the base housing in the height direction, an insulative slide housing wherein a second contacting face facing the height direction is formed at one end thereof in the height direction to contact the first contacting face of the base housing and second through holes to be continuous with the first through holes of the base housing are provided to penetrate the slide housing in the height direction, and conductive contacts being to be inserted into the first through hole of the base housing and the second through hole of the slide housing from one side in the height direction and having a connecting part, which is to be pressed into the first through hole of the base housing and of which top end part is to protrude from the first through hole and be connected to a conductor of an external member, a contacting part, which is to be pressed into the second through hole of the slide housing and to contact a contact of a counterpart connector, and a floating part, which is provided between the connecting part and the contacting part and is able to undergo elastic deformation so that the contacting part and the connecting part can shift in any directions perpendicular to the height direction, and the floating connector being so structured that either one of the base housing and the slide housing is provided with protruding parts protruding on both sides in the width direction thereof, the other one of the base housing and the slide housing is provided with grooves on both sides in the width direction thereof, the grooves being concaved outward in the width direction, extending in the depth direction and being open at least on this side in the depth direction, and the protruding parts are inserted into the grooves, leaving spaces in both the width direction and the depth direction to enable the slide housing to slide in relation to the base housing in any direction perpendicular to the height direction while restraining the slide housing from shifting in the height direction.

2. The floating connector as recited in claim 1, wherein the floating part of the contact is structured by providing a first plate face and a second plate face facing two directions, which are perpendicular to the height direction and cross mutually, in succession in the height direction.

3. The floating connector as recited in claim 1, wherein a second protruding part that bites into a wall constituting the second through hole is formed on the contacting part of the contact, and the first through hole is so provided that this contacting part and the second protruding part can pass through it, and a first protruding part that bites into a wall constituting the first through hole is formed on the connecting part of the contact.

4. The floating connector as recited in claim 2, wherein a second protruding part that bites into a wall constituting the second through hole is formed on the contacting part of the contact, and the first through hole is so provided that this contacting part and the second protruding part can pass through it, and a first protruding part that bites into a wall constituting the first through hole is formed on the connecting part of the contact.

5. The floating connector as recited in claim 1, wherein a locking part that fits on the counterpart connector is provided on the slide housing.

6. The floating connector as recited in claim 2, wherein a locking part that fits on the counterpart connector is provided on the slide housing.

7. The floating connector as recited in claim 3, wherein a locking part that fits on the counterpart connector is provided on the slide housing.

8. The floating connector as recited in claim 4, wherein a locking part that fits on the counterpart connector is provided on the slide housing.

* * * * *